US006167895B1

(12) United States Patent
Burroughs

(10) Patent No.: US 6,167,895 B1
(45) Date of Patent: Jan. 2, 2001

(54) ADJUSTABLE MOBILITY ASSISTANCE DEVICE

(76) Inventor: Gary W. Burroughs, 4506 Chapparal Dr., Baytown, TX (US) 77521-2524

( * ) Notice: Under 35 U.S.C. 154(b), the term of this patent shall be extended for 0 days.

(21) Appl. No.: 09/415,008

(22) Filed: Oct. 8, 1999

(51) Int. Cl.[7] ..... A61G 7/10; A45B 1/00
(52) U.S. Cl. ..... 135/66; 5/83.1; 135/67
(58) Field of Search ..... 135/65, 66, 67; 211/99, 100, 117; 5/83.1

(56) References Cited

U.S. PATENT DOCUMENTS

| | | | | |
|---|---|---|---|---|
| D. 342,435 | | 12/1993 | Boyle . | |
| 426,313 | * | 4/1890 | Paxson | 211/99 |
| 2,642,117 | | 6/1953 | Glauber . | |
| 2,875,903 | * | 3/1959 | Shourds | 211/100 |
| 4,844,107 | | 7/1989 | Watkins . | |
| 5,235,711 | * | 8/1993 | Jandrakovic | 5/83.1 X |
| 5,305,773 | | 4/1994 | Browning . | |
| 5,313,982 | | 5/1994 | Johnston . | |
| 5,630,236 | | 5/1997 | Messin . | |
| 5,662,131 | * | 9/1997 | Scarborough et al. | 135/66 X |

* cited by examiner

*Primary Examiner*—Peter R. Brown

(57) ABSTRACT

An adjustable mobility assistance device for providing a wall-mounted handle having a pulley assembly for extending the handle to an operable position includes a handlebar pivotally coupled to a wall and a pulley system for raising the handlebar to a usable position. In an embodiment, the handlebar is provided with a plurality of adjustable portions to permit adjustment of the width of the handlebar and the distance of extension of a gripping portion of the handlebar from the wall.

10 Claims, 3 Drawing Sheets

ADJUSTABLE MOBILITY ASSISTANCE DEVICE

BACKGROUND OF THE INVENTION

1. Field of the Invention

The present invention relates to mobility assistance devices and more particularly pertains to a new adjustable mobility assistance device for providing a wall-mounted handle having a pulley assembly for extending the handle to an operable position.

2. Description of the Prior Art

The use of mobility assistance devices is known in the prior art. More specifically, mobility assistance devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,630,236; U.S. Pat. No. 5,305,773; U.S. Pat. No. 4,844,107; U.S. Pat. No. Des. 342,435; U.S. Pat. No. 5,303,982; and U.S. Pat. No. 2,642,117.

While these devices fulfill their respective, particular objectives and requirements, the aforementioned patents do not disclose a new adjustable mobility assistance device. The inventive device includes a handlebar pivotally coupled to a wall and a pulley system for raising the handlebar to a usable position.

In these respects, the adjustable mobility assistance device according to the present invention substantially departs from the conventional concepts and designs of the prior art, and in so doing provides an apparatus primarily developed for the purpose of providing a wall-mounted handle having a pulley assembly for extending the handle to an operable position.

SUMMARY OF THE INVENTION

In view of the foregoing disadvantages inherent in the known types of mobility assistance devices now present in the prior art, the present invention provides a new adjustable mobility assistance device construction wherein the same can be utilized for providing a wall-mounted handle having a pulley assembly for extending the handle to an operable position.

The general purpose of the present invention, which will be described subsequently in greater detail, is to provide a new adjustable mobility assistance device apparatus and method which has many of the advantages of the mobility assistance devices mentioned heretofore and many novel features that result in a new adjustable mobility assistance device which is not anticipated, rendered obvious, suggested, or even implied by any of the prior art mobility assistance devices, either alone or in any combination thereof.

To attain this, the present invention generally comprises a handlebar pivotally coupled to a wall and a pulley system for raising the handlebar to a usable position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable mobility assistance device apparatus and method which has many of the advantages of the mobility assistance devices mentioned heretofore and many novel features that result in a new adjustable mobility assistance device which is not anticipated, rendered obvious, suggested, or even implied by any of the prior art mobility assistance devices, either alone or in any combination thereof.

It is another object of the present invention to provide a new adjustable mobility assistance device that may be easily and efficiently manufactured and marketed.

It is a further object of the present invention to provide a new adjustable mobility assistance device that is of a durable and reliable construction.

An even further object of the present invention is to provide a new adjustable mobility assistance device which is susceptible of a low cost of manufacture with regard to both materials and labor, and which accordingly is then susceptible of low prices of sale to the consuming public, thereby making such adjustable mobility assistance device economically available to the buying public.

Still yet another object of the present invention is to provide a new adjustable mobility assistance device which provides in the apparatuses and methods of the prior art some of the advantages thereof, while simultaneously overcoming some of the disadvantages normally associated therewith.

Still another object of the present invention is to provide a new adjustable mobility assistance device for providing a wall-mounted handle having a pulley assembly for extending the handle to an operable position.

Yet another object of the present invention is to provide a new adjustable mobility assistance device which includes a handlebar pivotally coupled to a wall and a pulley system for raising the handlebar to a usable position.

Still yet another object of the present invention is to provide a new adjustable mobility assistance device that is mountable to a wall proximate a toilet facility such that a cable is positioned near the toilet facility for pulling a handlebar into a reachable position while a user is seated on the toilet facility.

Even still another object of the present invention is to provide a new adjustable mobility assistance device that remains in a retracted position against a wall until a pulley system is activated to extend a handlebar into reach of a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
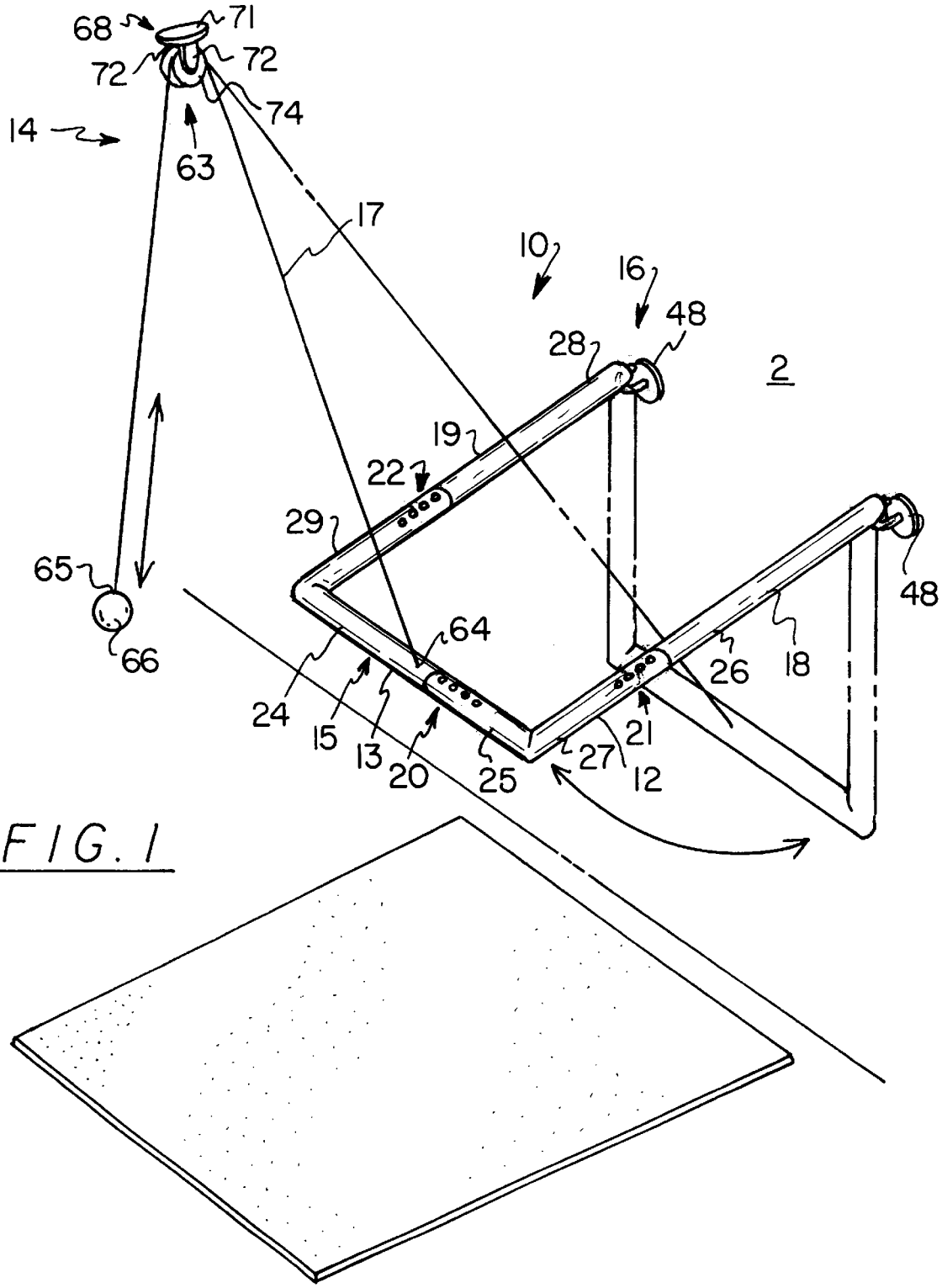
FIG. 1 is a perspective view of a new adjustable mobility assistance device according to the present invention.
Figure 2:
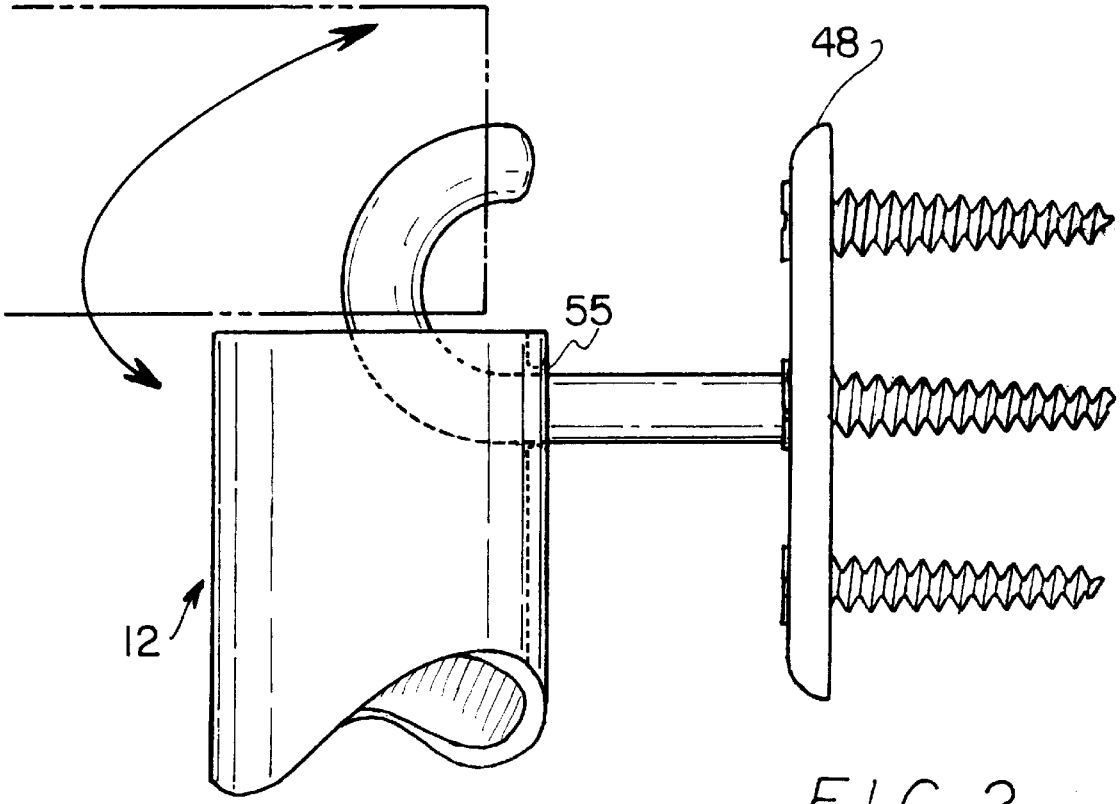
FIG. 2 is a side view of the handlebar and hook connection of the present invention.
Figure 3:
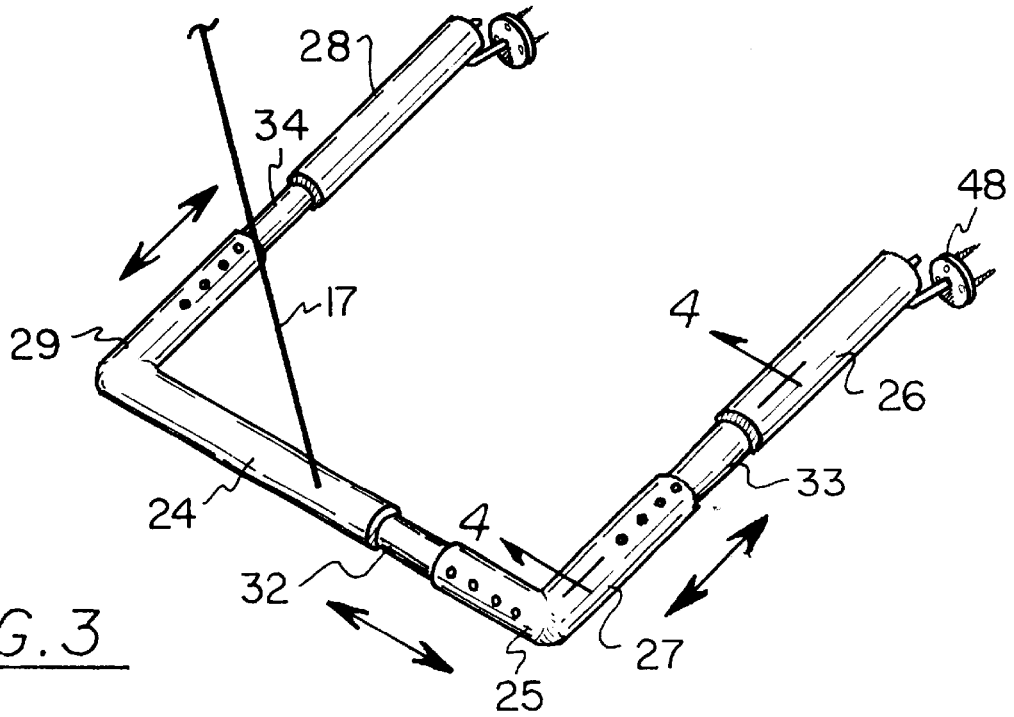
FIG. 3 is a perspective view of the handlebar of the present invention.
Figure 4:
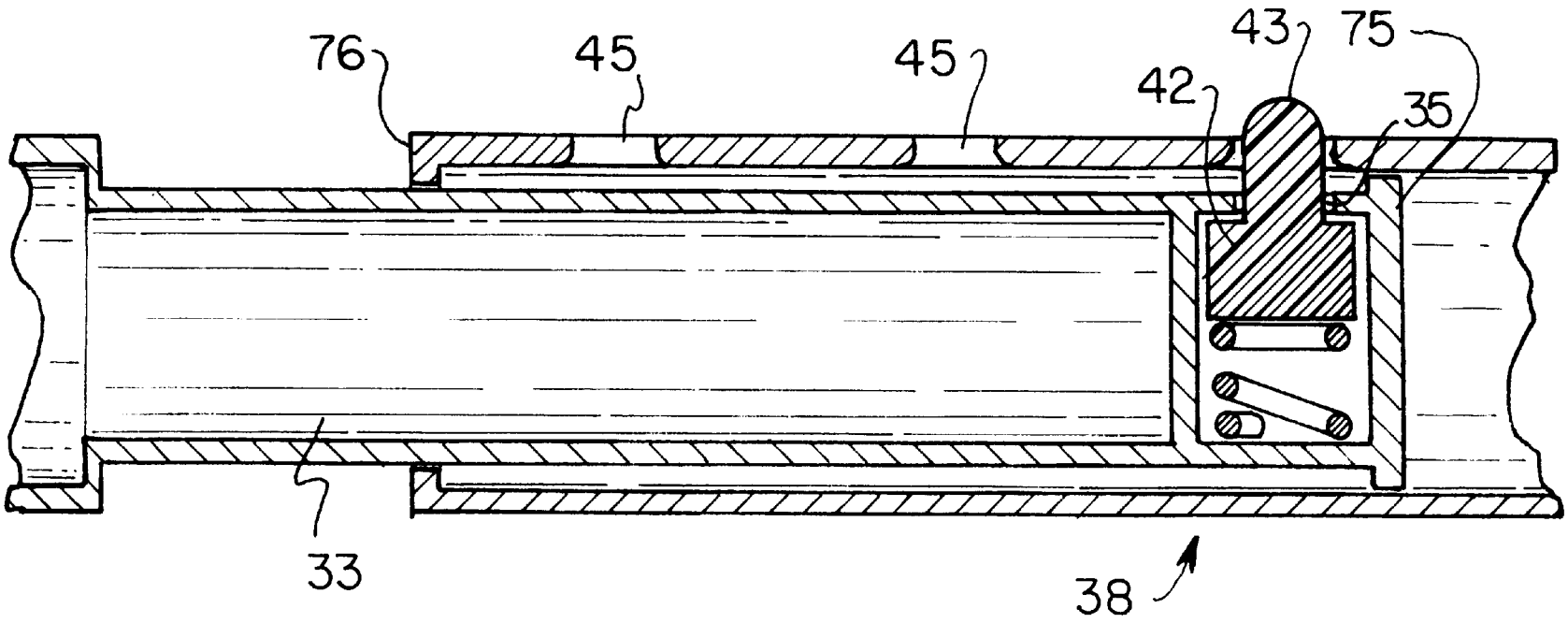
FIG. 4 is a cross-sectional view of the invention taken along line 4—4 of FIG. 3.

With reference now to the drawings, and in particular to FIGS. 1 through 4 thereof, a new adjustable mobility assistance device embodying the principles and concepts of the present invention and generally designated by the reference numeral 10 will be described.

As best illustrated in FIGS. 1 through 4, the adjustable mobility assistance device 10 generally comprises a handlebar 12 designed for pivotally coupling to a wall 2 and a pulley assembly 14 for pulling the handlebar into a reachable position to assist a user in a transition between a seated position and a standing position. The handlebar includes a gripping portion 15 positioned distally with respect to a pivotal coupling 16 such that the gripping portion is extendable from the wall.

The pulley system is coupled to the handlebar and includes a cable 17 operationally coupled to the handlebar for pulling the handlebar to extend the gripping portion away from the wall when the cable is pulled.

In an embodiment, the handlebar is generally U-shaped and including a cross bar 13 and a pair of side bars 18 and 19. Each side bar extends from an associated end of the cross bar.

The cross bar and the side bars each include a respective adjustment assembly 20, 21, and 22 for selectively adjusting a respective length of the cross bar and side bars. Each of the adjustment assemblies has similar structure. The cross bar has a first member 24 and an associated second member 25 adjustably coupled to the first member 24. Each side bar includes a respective first member 26, 28 and an associated second member 27, 29 adjustably coupled to the first member 26, 28. Each respective first member 24, 26, 28 includes an insertion portion 32, 33, 34 that is slidably insertable into the associated second portion 25, 27, 29. Each first member 24, 26, 28 includes an aperture 35 therein and a stopping assembly 38. The stopping assembly includes a stopping member 42. The stopping member is biased into an extended position defined by a rounded distal end 43 of the stopping member being extended through the aperture 35 and protruding outwardly from an outer surface of the insertion portion. The stopping member is pressable towards the insertion portion such that the stopping member is substantially positioned within the insertion portion to define a retracted position.

Each associated second member includes a plurality of spaced holes 45. The holes are arranged along a length of the second member and are positioned to receive the stopping member when the stopping assembly is in the extended position. Thus, a length of the cross bar and side bars is adjustable by positioning the stopping member in a selectable one of the plurality of spaced holes in the associated second member.

The device 10 also includes a pair of hooks 48. Each hook is designed for mounting on the wall. In an embodiment, screws are used to fixedly mount the hooks to the wall. Each side bar includes a hook aperture 55. Each hook is inserted through an associated one of the hook apertures such that the hooks support the handlebar. The hooks are turned upwardly and are slidable within the hook apertures whereby the handlebar is pivotally coupled to the hooks such that the cross bar is extendable away from the wall.

The pulley system includes a pulley 62 designed for coupling to a ceiling such that the pulley extends downwardly from the ceiling. In an embodiment, the pulley is coupled to the ceiling in a position horizontally spaced from the cross bar when the side bars extend substantially orthogonally from the wall to facilitate lifting of the handlebar by pulling on the cable.

The cable is coupled to the cross bar at a first end 64 and a weight member 66 is coupled to a second end 65 of the cable. A medial portion 63 of the cable is supported by the pulley. The weight member is designed for maintaining tension in the cable such that the cable is prevented from disengaging from the pulley. The weight member is also designed to provide some counterbalance to the weight of the handlebar to facilitate lifting of the handlebar by disabled or otherwise weakened users. The weight member is designed for grasping by a user to facilitate pulling of the cable to extend the cross bar away from the wall into a reachable position whereby the handlebar is graspable to provide support to facilitate a transition between a standing position and a seated position. The device 10 is particularly designed for use in association with a toilet or other furniture that requires a transition between a standing position and either a seated or supine position.

The pulley includes a mounting bracket 68 having a substantially planar backing member 71 and pair of spaced arms 72 extending outwardly from the backing member. The pulley includes a wheel 74 rotatably coupled between the arms. The weight member is generally spherical having a diameter greater than a distance between the spaced arms for preventing the second end of the cable from passing through the pulley.

In an embodiment, a distal end of each insertion portion includes a protruding annular flange 75 and a distal end of each associated second member includes an inwardly disposed lip 76. The flange is positioned to abut against an associated lip for preventing the insertion portion from sliding out of the second member.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mobility assistance device for assisting a user in a transition between a standing position and a seated position, the device comprising:

a handlebar pivotally adapted for pivotally coupling to a wall, the handlebar having a gripping portion positioned distally with respect to the pivotal coupling such that the gripping portion is extendable from the wall; and a pulley system coupled to the handlebar, the pulley system having a cable operationally coupled to the handlebar for pulling the handlebar to extend the gripping portion away from the wall when the cable is pulled.

2. The mobility assistance device of claim 1, further comprising:

said handlebar being generally U-shaped and including a cross bar and a pair of side bars, each side bar extending from an associated end of said cross bar; and wherein said gripping portion is located along said cross bar.

3. The mobility assistance device of claim 2, further comprising:

each of said cross bar and said side bars having a respective adjustment assembly for selectively adjusting a respective length of the cross bar and side bars.

4. The mobility assistance device of claim 3, wherein said adjustment assemblies comprise:

said cross bar having a first member and an associated second member adjustably coupled to said first member, each side bar having a respective first member and an associated second member adjustably coupled to said first member;

each respective first member of said cross bars and said side bars having an insertion portion being slidably insertable into said associated second portion;

each said first member having an aperture therein and a stopping assembly, said stopping assembly having a stopping member, said stopping member being biased into an extended position defined by a distal end of a stopping member of said stopping assembly extending through said aperture and protruding outwardly from an outer surface of the insertion portion, said stopping member being pressable towards said insertion portion such that said stopping member is substantially positioned within said insertion portion to define a retracted position;

each associated second member having a plurality of spaced holes, each of said holes arranged along a length of said second member, said holes being positioned to receive said stopping member when said stopping assembly is in said extended position whereby a length of said cross bar and side bars is adjustable by positioning said stopping member is a selectable one of said plurality of spaced holes in said associated second member.

5. The mobility assistance device of claim 4, further comprising:

a distal end of each insertion portion having a protruding annular flange;

a distal end of each associated second member having an inwardly disposed lip; and wherein each said flange is positioned to abut against an associated lip for preventing said insertion portion from sliding out of said second member.

6. The mobility assistance device of claim 2, further comprising:

a pair of hooks, each hook being adapted for mounting on a wall;

each side bar including a hook aperture, each hook being inserted through an associated one of said hook apertures such that said hooks support said handlebar.

7. The mobility assistance device of claim 6, further comprising:

said hooks being turned upwardly and slidable within said hook apertures whereby said handlebar is pivotally coupled to said hooks such that said cross bar of said handlebar is extendable away from the wall.

8. The mobility assistance device of claim 2, further comprising:

said pulley system including a pulley adapted for coupling to a ceiling such that said pulley extends downwardly from the ceiling, said pulley being coupled to the ceiling in a position horizontally spaced from said cross bar when said side bars extend substantially orthogonally from the wall;

a medial portion of said cable being supported by said pulley;

a first end of said cable being coupled to said cross bar; and a weight member being coupled to a second end of said cable opposite said first end, said weight member being for maintaining tension in said cable such that said cable is prevented from disengaging from said pulley; and said weight member being adapted for grasping by a user to facilitate pulling of said cable to extend said cross bar away from the wall into a reachable position whereby said handlebar is graspable to provide support to facilitate a transition between a standing position and a seated position.

9. The mobility assistance device of claim 8, further comprising:

said pulley having a mounting bracket having a substantially planar backing member and pair of spaced arms extending outwardly from said backing member, said pulley having a wheel rotatably coupled between said arms; and wherein said weight member is generally spherical, said weight member having a diameter greater than a distance between said spaced arms for preventing said second end of said cable from passing through said pulley.

10. A mobility assistance device for assisting a user in a transition between a standing position and a seated position, the device comprising:

a handlebar pivotally adapted for pivotally coupling to a wall, the handlebar having a gripping portion positioned distally with respect to the pivotal coupling such that the gripping portion is extendable from the wall;

a pulley system coupled to the handlebar, the pulley system having a cable operationally coupled to the handlebar for pulling the handlebar to extend the gripping portion away from the wall when the cable is pulled;

said handlebar being generally U-shaped and including a cross bar and a pair of side bars, each side bar extending from an associated end of said cross bar;

wherein said gripping portion is located along said cross bar;

each of said cross bar and said side bars having a respective adjustment assembly for selectively adjusting a respective length of the cross bar and side bars;

wherein said adjustment assemblies include said cross bar having a first member and an associated second member adjustably coupled to said first member, each side bar having a respective first member and an associated second member adjustably coupled to said first member, each respective first member of said cross bars and said side bars having an insertion portion being slidably insertable into said associated second portion, each said first member having an aperture therein and a stopping assembly, said stopping assembly having a stopping member, said stopping member being biased into an extended position defined by a distal end of a stopping member of said stopping assembly extending through said aperture and protruding outwardly from an outer surface of the insertion portion, said stopping member being pressable towards said insertion portion such that said stopping member is substantially positioned within said insertion portion to define a retracted position, and each associated second member having a plurality of spaced holes, each of said holes arranged along a length of said second member, said holes being positioned to receive said stopping member when said stopping assembly is in said extended position whereby a length of said cross bar and side bars is adjustable by positioning said stopping member is a selectable one of said plurality of spaced holes in said associated second member;

a pair of hooks, each hook being adapted for mounting on a wall;

each side bar including a hook aperture, each hook being inserted through an associated one of said hook apertures such that said hooks support said handlebar;

said hooks being turned upwardly and slidable within said hook apertures whereby said handlebar is pivotally coupled to said hooks such that said cross bar of said handlebar is extendable away from the wall;

said pulley system including a pulley adapted for coupling to a ceiling such that said pulley extends downwardly from the ceiling, said pulley being coupled to the ceiling in a position horizontally spaced from said cross bar when said side bars extend substantially orthogonally from the wall;

a medial portion of said cable being supported by said pulley;

a first end of said cable being coupled to said cross bar;

a weight member being coupled to a second end of said cable opposite said first end, said weight member being for maintaining tension in said cable such that said cable is prevented from disengaging from said pulley;

said weight member being adapted for grasping by a user to facilitate pulling of said cable to extend said cross bar away from the wall into a reachable position whereby said handlebar is graspable to provide support to facilitate a transition between a standing position and a seated position;

said pulley having a mounting bracket having a substantially planar backing member and pair of spaced arms extending outwardly from said backing member, said pulley having a wheel rotatably coupled between said arms;

wherein said weight member is generally spherical, said weight member having a diameter greater than a distance between said spaced arms for preventing said second end of said cable from passing through said pulley;

a distal end of each insertion portion having a protruding annular flange;

a distal end of each associated second member having an inwardly disposed lip; and wherein each said flange is positioned to abut against an associated lip for preventing said insertion portion from sliding out of said second member.

* * * * *